US010081989B2

(12) United States Patent
Slack

(10) Patent No.: US 10,081,989 B2
(45) **Date of Patent: *Sep. 25, 2018**

(54) TOOL FOR GRIPPING TUBULAR ITEMS

(71) Applicant: Noetic Technologies Inc., Edmonton (CA)

(72) Inventor: Maurice W. Slack, Edmonton (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/846,147

(22) Filed: Dec. 18, 2017

(65) Prior Publication Data

US 2018/0106117 A1 Apr. 19, 2018

Related U.S. Application Data

(63) Continuation of application No. 14/428,981, filed as application No. PCT/CA2013/000873 on Oct. 9, 2013, now Pat. No. 9,869,143.

(60) Provisional application No. 61/711,404, filed on Oct. 9, 2012.

(51) Int. Cl.
*E21B 19/06* (2006.01)
*E21B 19/16* (2006.01)

(52) U.S. Cl.
CPC ..... *E21B 19/06* (2013.01); *E21B 19/16* (2013.01)

(58) Field of Classification Search
CPC ..... E21B 19/06; E21B 19/16; E21B 19/10
See application file for complete search history.

(56) References Cited

U.S. PATENT DOCUMENTS

| | | | | |
|---|---|---|---|---|
| 3,748,702 | A | 7/1973 | Brown | |
| 2005/0006147 | A1 | 1/2005 | Ayling | |
| 2008/0210063 | A1* | 9/2008 | Slack | E21B 19/06 81/420 |
| 2009/0145594 | A1 | 6/2009 | Slack | |

FOREIGN PATENT DOCUMENTS

| | | | |
|---|---|---|---|
| DE | 4015300 | C1 | 1/1992 |
| WO | 2007127737 | A2 | 11/2007 |

* cited by examiner

*Primary Examiner* — D. Andrews
*Assistant Examiner* — Kristyn A Hall
(74) *Attorney, Agent, or Firm* — Donald V. Tomkins

(57) ABSTRACT

A tool for gripping a tubular workpiece comprises: a land element for reacting compressive load against an end face of the workpiece; grip elements and grip element carrier means; a main body with means for converting axial motion of the tool relative to the workpiece into radial movement of the grip elements from a retracted position to an engaged position exerting radial load on the workpiece; and retractor means for retracting the grip elements from the workpiece the tool is displaced axially away from the workpiece. The grip element carrier means may comprise a cylindrical cage with the grip elements being radially slidable within circumferentially-spaced windows in the cage. The means for converting axial movement and load into radial movement and load may comprise a cone or ramp surface that bears against the grip elements such that radial loads from the grip surfaces are carried through the main body.

16 Claims, 5 Drawing Sheets

TOOL FOR GRIPPING TUBULAR ITEMS

FIELD OF THE DISCLOSURE

The present disclosure relates in general to tools or devices for gripping an outside surface of a pipe, pipe coupling, or other tubular item with large tolerances and with surface finishes typical of as-rolled steel. In particular, the disclosure relates to oilfield gripping tools, such as casing running tools, where reaction of torsional loads is required in order to operate, engage, or disengage the tool.

BACKGROUND

Mechanically-activated tools for gripping tubular articles or workpieces, such as tools described in U.S. Pat. No. 7,909,120 (Slack), can require some torque reaction in order to be activated and set. This torque reaction can be provided externally by manual or automated means separate from the primary load path and the workpiece; however, a typical method of reacting this torque is through frictional engagement with the tubular workpiece. Generally, such tools are provided with a land element (or "bumper") that is designed to engage the exposed face of the tubular (or coupling) and which requires some applied compressive load at this interface to generate the required friction to adequately react the required torque. In many cases the activation torque required varies with setdown load, and will be dependent on how the load is reacted internally, including the diameter and nature of the internal bearing faces, friction generated by rotating seals, and incidental friction resulting from lateral loads applied to the tool.

The variability of the load reaction in some tools results in situations where generating adequate torque reaction is either difficult or impossible to achieve consistently. Such inability to react adequate torque typically occurs when the diameter of the casing (or other tubular item or article), and consequently the diameter at which the land element is bearing and reacting torque on the casing, is small relative to the internal bearing surfaces of the tool and associated seals. The need to supplement or enhance this torque reaction is apparent in these cases. Some means for increasing this torque are known in the art, including:

1. Reacting the torque load at an angle relative to the applied setdown load (such as, by way of non-limiting example, a conical land element);
2. Adding friction-enhancing features, materials, and/or surface finish to the bearing face on the land element; and
3. Using means such as an internal air spring that will reduce the internally-reacted loads.

Such means have proved effective for use with some gripping tools, including internally-gripping casing running tools. However, uncertainty as to the ability to generate the required reaction has been increased by the recent development of external-gripping casing running tools having higher capacities and increased internal bearing and seal diameters relative to the casing diameter.

As such, there is a need for a mechanically-activated mechanism that will grip a pipe or coupling such that the gripping force has a mechanical advantage beyond that available with simple land element geometries reacting a generally axially-applied load on the face of the pipe or coupling. This need is especially apparent for pipe and couplings that have a limited ability to react bearing loads and torque on the exposed face, typical to some premium connections with flush or near-flush geometries.

BRIEF SUMMARY

In general terms, the present disclosure teaches a tool for gripping a tubular article or workpiece (such as but not restricted to a section or "joint" of threaded and coupled oilfield pipe) to facilitate application of torque to the tubular article. As used in this disclosure, the term "threaded and coupled pipe" is to be understood as denoting the assembly of a pipe having an externally-threaded end, onto which an internally-threaded coupling has been mounted. Embodiments of the tool are described and illustrated herein as specifically gripping the coupling of a threaded and coupled pipe assembly, and when used as such the tool may be alternatively referred to as a coupling gripper. However, such embodiments can also be used for gripping the pipe component of a threaded and coupled pipe assembly, or a plain pipe having no coupling, or for other tubular articles or workpieces.

More particularly, the present disclosure teaches a gripping tool for gripping a pipe or pipe coupling (or other tubular articles), in which the gripping tool incorporates:

- a body element with means for converting axial motion (i.e., motion in line with the axis of the pipe) of the gripping tool relative to the pipe into a radial movement of the grip elements from a retracted position to an engaged position, and, when engaged, providing means for converting axial load applied to the gripping tool to radial load;
- grip elements and grip element carrier means for carrying or containing the grip elements;
- a land element arranged to react axial compressive load against the field end face of a pipe or of a tubular coupling mounted to on the end of the pipe; and
- grip element retraction means for retracting the grip elements to disengage them from the pipe or coupling when the gripping tool is displaced axially away from the pipe or coupling.

Preferably (but not necessarily), the land element will have a smooth bearing face against which the end of a pipe or pipe coupling may be landed, and may be provided with radially-oriented slots or grooves to prevent the interface between the land element and a pipe face or coupling face landed against it from functioning as a seal whereby pressure may be contained in this interval or section of the assembly. The land element preferably will be attached to or incorporated into the grip element carrier such that axial load and movement applied to the land element are transmitted to the grip element carrier, thus enabling radial extension and retraction of the grip elements.

The grip elements are positioned to engage the pipe or coupling in a suitable location, taking into account the maximum anticipated grip loads, the range of possible engagement diameters, the subsequent deflection under load of the pipe or coupling, and the ability of the pipe or coupling to react the grip loads within allowable deformation limits, generally without permanent deformation or yielding. It is to be understood that the location where the grip elements engage the pipe or coupling can be at any axial position relative to the coupling face on either the inside or outside surface of either the pipe or the coupling.

The grip surfaces (i.e., the surfaces of the gripping elements that directly engage a pipe or coupling) are generally designed to minimize marking, penetration, and localized deformation. As may be desired, however, additional frictional torque reaction may be attained by providing grip-enhancing features (such as die teeth) on this surface to increase the effective friction coefficient at the interface between the grip element and the pipe or coupling.

The grip element carrier is provided with means for carrying and containing the grip elements. Such means could be provided, by way of non-limiting example, in the form of a generally cylindrical cage in which the grip elements are arranged as buttons that are radially slidable within openings or "windows" formed in the cage. In such embodiments, the buttons preferably will be in close-fitting engagement with the cage windows, and may also sealingly engage the perimeter surfaces of the cage windows. The means for carrying the grip elements may also comprise a collet arrangement wherein the grip elements are attached to a plurality of adjacent spring elements. Such spring elements would generally be arranged axially, with one end of each spring being retained and attached to the land element, and the other end attached to the grip elements.

The body element is provided with means for converting axial movement and load into radial movement and load relative to the pipe or coupling surface. Such means may comprise a cone or ramp surface that bears against the grip elements, generally opposite to the grip surfaces of the grip elements, such that radial loads from the grip surfaces are carried through the body element.

The means for reacting torque transmitted to the grip elements from the pipe or coupling may be provided by either the grip element carrier or the body element. For example, the carrier and/or the body element may be rotationally constrained to the gripping tool such that the grip elements are rotationally constrained to the carrier, constrained to the body, or frictionally engaged with the body.

The grip element retraction means may be separate from or integral with other elements of the assembly, and may be provided in a variety of alternative forms. By way of non-limiting example, the retraction means for retracting the grip elements associated with the retractor element may comprise a retractor cone engageable with mating surfaces on the grip elements when bearing loads are removed, with the retractor cone being driven by a compressive spring. The retraction means may also include radial collet springs, which can be integral with the carrier element and arranged such that the spring preload is selected to be biased in the radial direction opposite to the direction of engagement.

Embodiments within the scope of the present disclosure are not limited to tools that are operable to grip an external cylindrical surface of a tubular article, but also include tools that are operable to grip an internal cylindrical surface of a tubular article. In general terms, therefore, the present disclosure teaches a tool for gripping a target surface on a tubular article having an internal cylindrical surface and an external cylindrical surface, with the target surface being a selected one of the internal and external cylindrical surfaces, and with the tool comprising:

- a generally cylindrical main body having an upper end and a lower end, with a lower region of the main body defining a frustoconical surface, arranged to form a downwardly-diverging annular space relative to the target surface when the tubular article is coaxially disposed within the main body;
- a plurality of grip elements, with each grip element having a grip surface and a frustoconical surface, with the frustoconical surface of the grip element being slidingly engageable with the frustoconical surface of the main body;
- a generally cylindrical grip element carrier carrying said plurality of grip elements, with the grip element carrier being adapted such that the grip elements are axially movable with the grip element carrier while being radially movable within grip element windows formed in the grip element carrier, and with the grip element carrier being coaxially disposed within the main body and being axially movable relative thereto;
- a generally ring-shaped land element fixed to a downward-facing shoulder formed on the grip element carrier in a region above the grip elements, with the land element defining a downward-facing annular bearing face; and
- preload means, for biasing the grip element carrier downward relative to the main body so as to bias the tool toward a disengaged position;

such that application of a sufficient downward axial force to the main body will move the main body axially downward relative to the grip element carrier, thereby bringing the frustoconical surfaces of the grip elements into engagement with the frustoconical surface of the main body and causing radial displacement of the grip elements toward the target surface due to axial movement of the grip elements along the frustoconical surface of the main body.

BRIEF DESCRIPTION OF THE DRAWINGS

Embodiments in accordance with the present disclosure will now be described with reference to the accompanying figures, in which numerical references denote like parts, and in which.

DETAILED DESCRIPTION

Figure 1:
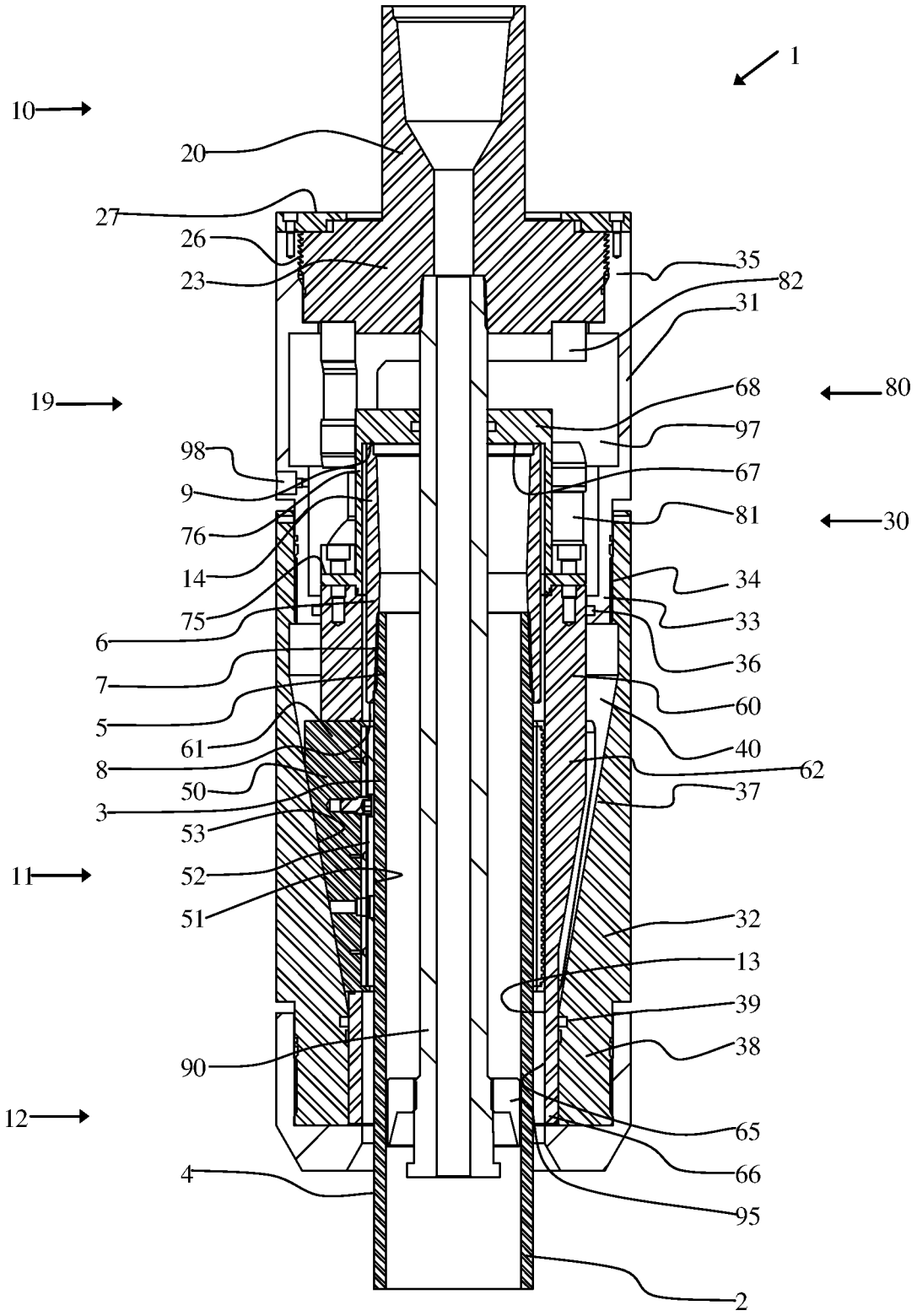
FIG. 1 (prior art)
FIG. 1 is a cross-section through a prior art tubular running tool provided with an external bi-axially activated wedge grip mechanism, shown as it appears in the set position gripping the upper end of a threaded and coupled section of casing.

FIG. 1 illustrates an example of a prior art tubular running tool provided with an external bi-axially activated wedge grip mechanism, as disclosed in U.S. Pat. No. 7,909,120 (Slack). FIG. 1 is provided for reference and to illustrate an exemplary context for the application and use of gripping tools in accordance with the present disclosure.

FIG. 1 specifically illustrates an "external" tubular running tool, generally denoted by the reference number 1, with a grip element in the form of a wedge-grip incorporated into the mechanically set and unset tubular running tool 1. The torque activation architecture of the tubular running tool 1 in FIG. 1 has a cam surface acting between the grip elements of running tool 1 and the body of running tool 1. Tubular running tool 1 is shown in FIG. 1 in an exterior gripping configuration relative to a tubular workpiece 2, as running tool 1 would be configured for running casing strings comprising casing joints or pipe segments joined by threaded connections arranged to have a 'box up, pin down' field presentation, where the most common type of connection is referred to as threaded and coupled. In such applications where tubular running tool 1 is used to run casing strings, it may alternatively be referred to as a casing running tool (or "CRT").

Workpiece 2 is shown in FIG. 1 as a threaded and coupled casing joint comprising a pipe body 3 with an exterior surface 4 and an upper externally-threaded pin end 5 pre-assembled, by so-called "mill end make-up", to an internally-threaded coupling 6 forming a "mill end connection" 7. As illustrated in FIG.1, casing running tool (CRT) 1 is configured to grip pipe body 3 below the bottom end face 8 of coupling 6, with the top end face 9 of coupling 6 thus being landed at least one coupling length above the grip location.

As illustrated in FIG. 1, prior art CRT 1 comprises a drive module 19, a grip module 11, and a seal element 95. Drive module 19 generally comprises a load adaptor 20, a main body 30, and a cam pair 80. Grip module 11 generally comprises a bell 32, a cage 60, and jaws 50. CRT 1 is shown in its set position, as it appears when engaged with and gripping tubular workpiece 2 and configured at its upper end 10 for connection to a top drive quill, or to the distal (i.e., lower) end of such drive string components as may be attached thereto, by means of load adaptor 20. Load adaptor 20 connects a top drive to an external bi-axially-activated grip module 11 having at its lower end 12 an interior opening 13 where the external gripping interface is located and into which interior opening 13 the upper (or proximal) end 14 of tubular workpiece 2 may be inserted and coaxially located.

Main body 30 is provided as a sub-assembly comprising an upper body 31 and bell 32, and joined at its lower end 33 by a threaded and pinned connection 34. Load adaptor 20 sealingly and rigidly connects to upper body 31 at its upper end 35 by means of a load thread 26 and a torque lock plate 27, which is keyed both to load adaptor 20 and to upper body 31, to thus structurally join load adaptor 20 to main body 30 enabling transfer of axial, torsional and perhaps bending loads as required for operation. Upper body 31 has a generally cylindrical external surface and a generally axi-symmetric internal surface carrying seal 36. Bell 32 similarly has a generally cylindrical external surface and profiled axi-symmetric internal surface characterized by a frusto-conical ramp surface 37 and a lower seal housing 38 carrying a lower annular seal 39, where the taper direction of ramp surface 37 is selected so that its diameter decreases downward, thus defining an interval of the annular space 40 between main body 30 and the exterior pipe body surface 4 in which the radial thickness decreases downward.

A plurality of jaws 50, illustrated in FIG. 1 by five (5) jaws, are made from a suitably strong and rigid material and are circumferentially distributed and coaxially located in annular space 40, close fitting with both the pipe body exterior surface 4 and frustoconical ramp surface 37 when CRT 1 is in its set position, as shown in FIG. 1. The internal surfaces 51 of jaws 50 are shaped to conform with the pipe body exterior surface 4, and are typically provided with rigidly attached dies 52 adapted to carry internal grip surfaces 51 configured with a surface finish to provide effective tractional engagement with the pipe body 3 (for example, a coarse, profiled, and hardened surface finish typical of tong dies). The external surfaces 53 of jaws 50 are shaped to closely fit with frustoconical ramp surface 37 of bell 32 and have a surface finish promoting sliding when in contact under load.

Cage 60, made of a suitably strong and rigid material, carries and aligns the plurality of jaws 50 within cage windows 61 provided in cage body 62, and this sub-assembly is coaxially located in annular space 40, with its interior surface generally defining interior opening 13, and with its exterior surface generally fitting with the interior profile of the main body 30.

Referring still to FIG. 1, cage 60 has a cylindrical inside surface 65 extending from its lower end 66 upward to an internally-upset (i.e., downward-facing) land surface 67 located at the upper end 68 of cage 60 at a location selected to contact and axially locate the top coupling face 9 of workpiece 2, within interior opening 13, such that jaws 50 grip pipe body 3 below the coupling bottom face 8. Land surface 67 may alternatively be configured as a separate land element provided to enhance the characteristic frictional engagement required to release the latch and set the tool and to re-engage the latch teeth upon unsetting of the tool.

A sealed upper cavity 97 is formed in an interior region bounded by load adaptor 20, upper body 31, cage 60 and stinger 90 where sliding seals 36 and 39 allow the cage to act as a piston with respect to the main body. Gas pressure introduced into sealed cavity 97 through valved port 98 therefore acts as a pre-stressed compliant spring tending to push the cage down relative to the main body.

Thus configured with the tool set, the jaws 50 act as wedges between main body 30 and workpiece 2 under application of hoisting loads, thus providing the uni-directional axial load activation typical of wedge-grip mechanisms, whereby an increase in the hoisting load tends to cause the jaws to stroke down and radially inward against the workpiece 2, thus increasing the radial gripping force exerted on workpiece 2 and enabling CRT 1 to react hoisting loads from the top drive into the casing. Gas pressure in upper cavity 97 similarly increases the radial gripping force of the jaws, tending to pre-stress the grip elements when the tool is set, and augments the gripping force produced by the hoisting load.

Cam pair 80 comprises a cage cam 81 and a body cam 82 which are generally tubular solid bodies made from suitably strong and thick material and axially aligned with each other. Cam pair 80 is located in the annular space of upper cavity 97, coaxial with and close fitting to cam housing interval 76 of cage 60. Cage cam 81 is located on and fastened to an upward-facing cam shoulder 75 on cage 60 and body cam 82 is located on and fastened to the lower end 23 of load adaptor 20.

Cam pair 80 functions to allow rotational activation in both direction and to provide a latch function that prevents setting of the tubular running tool. The cam and cam follower contact profiles, with associated angles of engagement (i.e., mechanical advantage, in both right and left hand directions, as the cam tends to climb and more generally ride on the cam follower) are thus selected according to application-specific requirements, to manipulate the relationship between applied torque and gripping force, and also to optimize secondary functions for specific applications, such as whether or not reverse torque is needed to release the tool subsequent to climbing the cam. Persons skilled in the art will appreciate that many variations in the cam and cam follower shapes can be used to generally exploit the advantages of a torque-activating grip as taught by the prior art.

The application of compressive load to load adaptor 20 by the top drive, sufficient to overcome the spring force generated by gas pressure in upper cavity 97, will be reacted externally by contact between coupling top face 9 and cage land surface 67, displacing the main body downward relative to the workpiece 2 and allowing jaws 50 to retract and draw away from the workpiece 2 thus unsetting or retracting tubular running tool 1, which position is latched by left-hand rotation of load adaptor 20 relative to workpiece 2 enabled by frictional engagement of land surface 67 on coupling top face 9, causing engagement of the latch teeth. Tubular running tool 1 is mechanically set and unset using only axial and rotational displacements, with associated forces being provided by the top drive without requiring actuation from a secondary energy source such as hydraulic or pneumatic power supplies.

Figure 2:
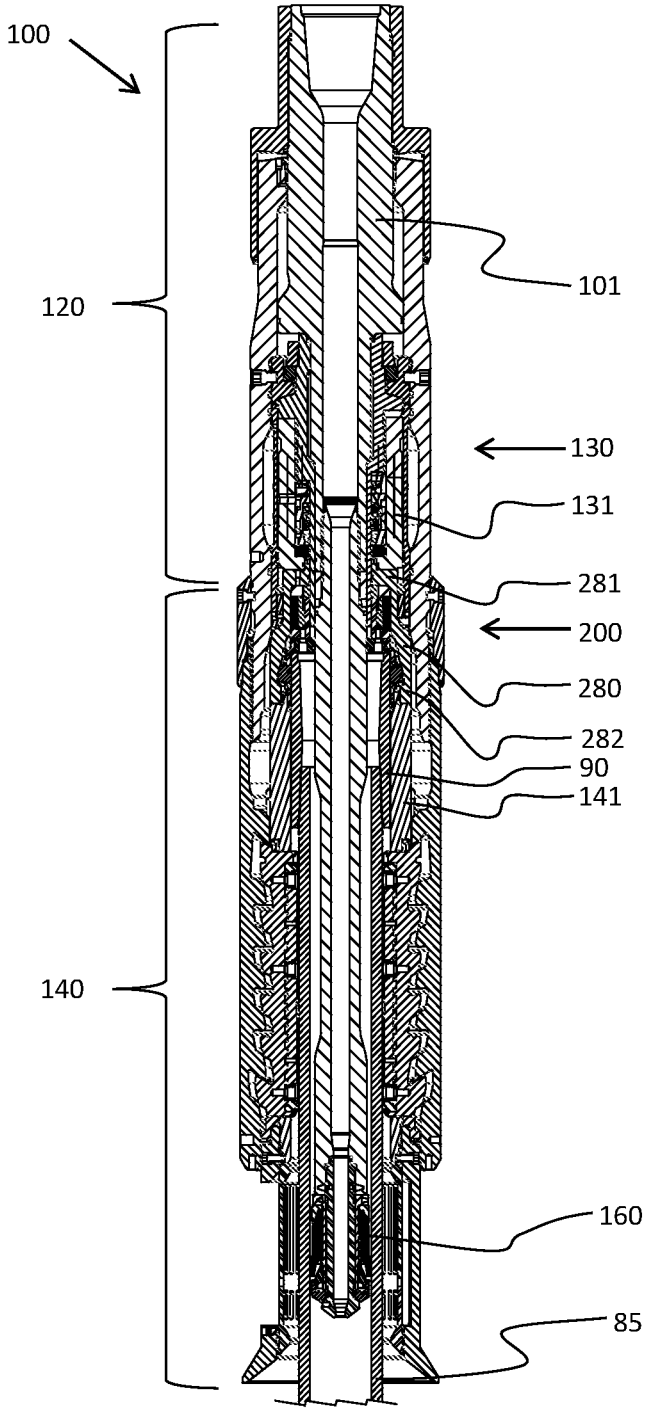
FIG. 2 is a cross-section through an externally-gripping tubular running tool incorporating an embodiment of a gripping tool in accordance with the present disclosure, shown engaged on a threaded and coupled pipe.

FIGS. 2 through 5 illustrate an embodiment of a coupling gripper generally in accordance with the present teachings. FIG. 2 is a cross-sectional view through an externally-gripping CRT 100 (shown, by way of example, as a tool in accordance with U.S. Pat. No. 7,909,120) as it would appear under axially-compressive load and engaged on a threaded and coupled pipe 85. In the embodiment illustrated in FIGS. 2 and 3, CRT 100 comprises a drive module 120, a grip module 140, a seal assembly 160, and a coupling gripper 200 having an upper end 201 and a lower end 202. Drive module 120 is arranged at upper end 101 of CRT 100 is designed to rigidly attach to the quill of a top-drive-equipped drilling rig (not shown). Torque and axial loads are carried through drive module 120 into grip module 140 and coupling gripper 200.

Figure 3:
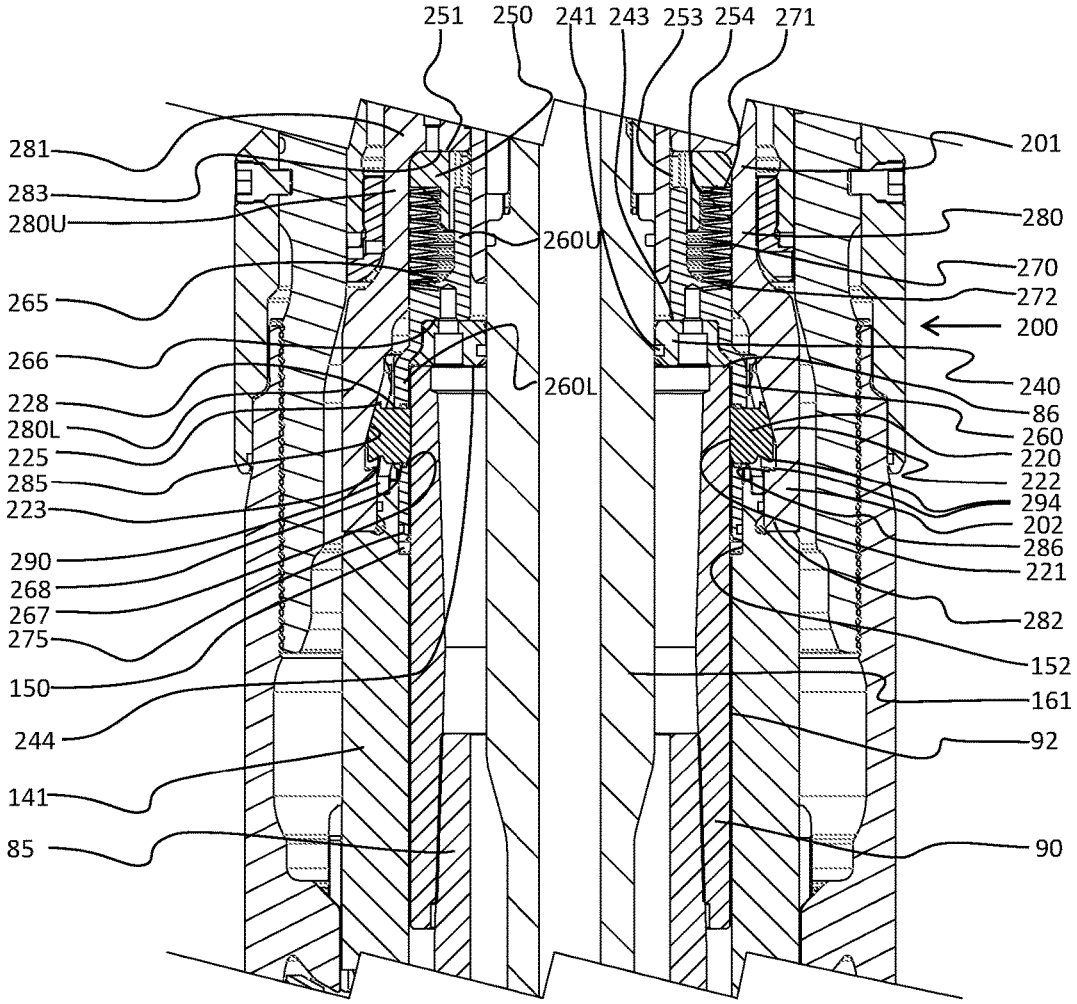
FIG. 3 is cross-sectional detail of the gripping tool of the assembly in FIG. 2, showing the gripping tool engaging the coupling of the threaded and coupled pipe assembly.

FIG. 3 is a partial cross-section through externally-gripping CRT 100 as in FIG. 2, showing in detail the coupling gripper 200 as it would appear in the extended position, engaged on the coupling 90 of a threaded and coupled pipe 85. Coupling gripper 200 comprises a generally cylindrical main body 280, a plurality of grip elements in the form of grip buttons 220 (ten in the illustrated embodiment, with two buttons 220 appearing in FIG. 3), and, a generally cylindrical grip button carrier 260, and a generally ring-shaped land element 240 fixed to carrier 260 (as described in greater detail later herein), for landing the upper end of a threaded and coupled pipe 85.

Main body 280, which has an upper end 281 and a lower end 282, is generally cylindrical in shape with a radially-stepped surface profile defining an upper body carrier interval 280U and a lower body interval 280L, with the diameter of lower body interval 280L being greater than the diameter of upper body interval 260U, which defines a downward-facing internal annular shoulder 283. As best seen in FIG. 3, lower body interval 280L defines an internal frustoconical engagement surface 285, the diameter of which increases toward the lower end of main body 280. Optionally, and as shown in FIG. 3, a frustoconical and upwardly peaked retractor cone 286 may be formed at the base of frustoconical engagement surface 285.

As shown in FIG. 2, upper end 281 of main body 280 is rigidly and coaxially attached to the lower cam 131 of a cam assembly 130 associated with drive module 120 of CRT 100, while lower end 282 is rigidly and coaxially attached to the upper end of a cylindrical cage 141 associated with grip module 140 of CRT 100. The cylindrical main bore of cage 141 is sized to receive the coupling 90 of threaded and coupled pipe 85 within reasonably close but not tight tolerances. An uppermost region of cage 141 has an enlarged bore diameter defining an annular recess 150 having a cylindrical surface 152 and an upward-facing annular shoulder 142.

As illustrated in FIG. 3, each grip button 220 has an internal grip surface 221 and a frustoconical outer surface 222, and may include a frustoconical retractor ramp 223 formed into a radially outer lower surface for engagement with optional retractor cone 286 on main body 280. Optionally, a retaining lip 225 may be formed on a radially outer upper surface, as illustrated in FIG. 3.

In the illustrated embodiment, grip button carrier 260 is generally cylindrical in shape and has a radially-stepped surface profile defining an upper carrier interval 260U and a lower carrier interval 260L, with the diameter of lower interval 260L being greater than the diameter of upper carrier interval 260U. In a medial region associated with the transition between upper and lower carrier intervals 260U and 260L, grip button carrier 260 defines an internal downward-facing annular shoulder 266, to which land element 240 is fixed. Grip element carrier 260 also defines an external upward-facing annular shoulder 265, associated with upper carrier interval 260U.

A plurality of windows 267 extend through the wall of lower carrier interval 260L, for receiving corresponding grip buttons 220. In the illustrated embodiment, the number of grip button windows 267 is ten, equal to the number of grip buttons 220, and they are evenly spaced around the circumference of lower carrier interval 260L. Grip button windows 267 optionally have seal grooves 268 for receiving seal elements (not shown) that function to sealingly engage the lateral faces 228 of grip buttons 220 while said grip buttons are slidingly engaged in grip button windows 267.

The lower end of lower interval 260L of carrier 260 is configured to be axially slidably disposable within annular recess 150 in the uppermost region of cage 141, between cylindrical surface 152 of recess 150 and the outer cylindrical surface of the coupling 90 of a threaded and coupled pipe 85. Below grip button windows 267, lower interval 260L of carrier 260 has a seal groove 275 carrying a seal element (not shown) slidingly and sealingly engageable with the cylindrical surface 152 in annular recess 150 of cage 141.

Referring again to FIG. 3, coupling gripper 200 includes a guide ring 250, which has an upper surface 251 that engages with and is rigidly attached to downward-facing shoulder 283 on main body 280, inside a splined surface 253. Guide ring 250 defines an external downward-facing shoulder 254. A Belleville spring stack 270, having an upper end 271 and a lower end 272, is disposed generally coaxially located between grip button carrier 260 and guide ring 250. More specifically, lower end 272 of Belleville spring stack 270 compressively engages upward-facing shoulder 265 on grip button carrier 260, and upper end 271 of spring stack 270 compressively engages downward-facing shoulder 254 on guide ring 250.

Land element 240 is generally ring-shaped, with a central bore for receiving a seal assembly stinger 161 associated with grip module 140 of CRT 100. On an inside surface of its central bore, land element 240 has a seal groove 241 carrying a seal element (not shown) for sealing engagement with stinger 161. Land element 240 has an upper face 243 which abuts and is rigidly attached to downward-facing shoulder 266 of grip button carrier 260.

Figure 5:
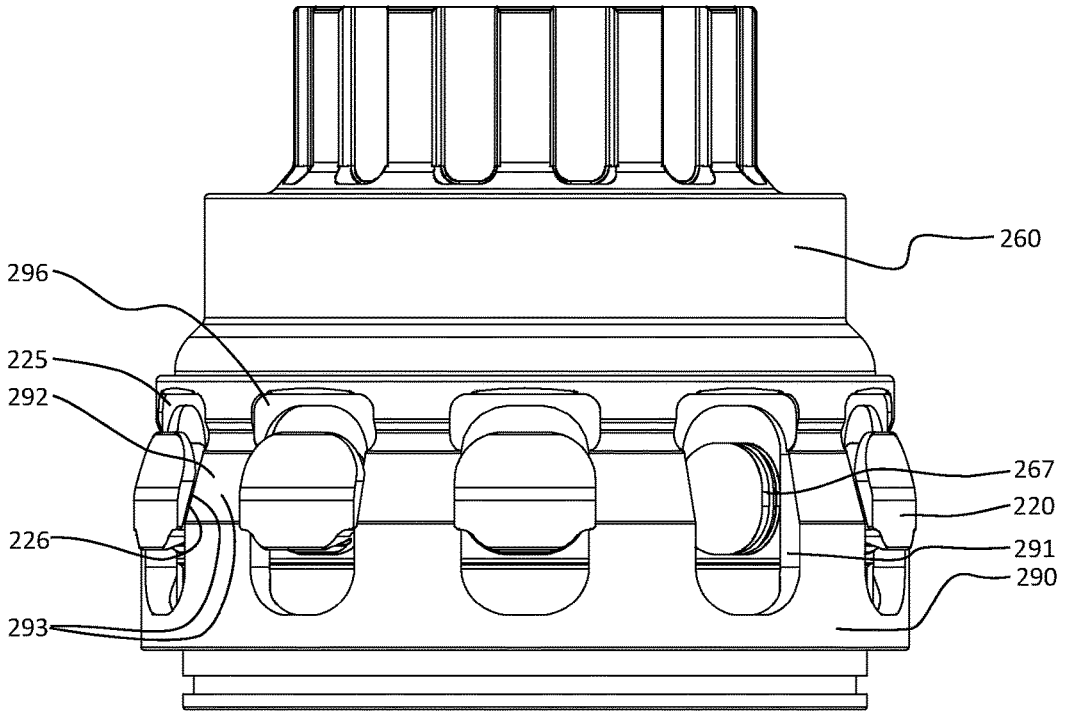
FIG. 5 is an external view of an assembly showing the retractor ring, grip button carrier, and grip buttons of the assembly in FIG. 2, shown with one button missing for illustrative purposes.

Referring now to FIG. 3, an annular retraction ring 290 is axially retained between main body 280 and cage 141, with retraction ring 290 having slots 291 sized and space to accommodate grip buttons 220. Referring now to FIG. 5, grip buttons 220 are arranged in windows 267 of grip button carrier 260 and slots 291 of retractor ring 290. An external frustoconical surface 292 on retraction ring 290 is configured for sliding engagement with inward-facing tapered retraction lips 226 on grip buttons 220 so as to constitute, in combination, a first retraction cam pair 293. First cam pair 293 functions to supplement a second cam pair 294 constituted by retractor cone 286 and retractor ramp 223 to provide axially-spring-driven mechanical cam retraction.

Referring again to FIG. 5, retaining lips 225 on grip buttons 220 are continuous with their corresponding retraction lips 226, and together limit the extent of radial stroke of grip buttons 220 through engagement on surfaces 296 and 292.

Figure 4:
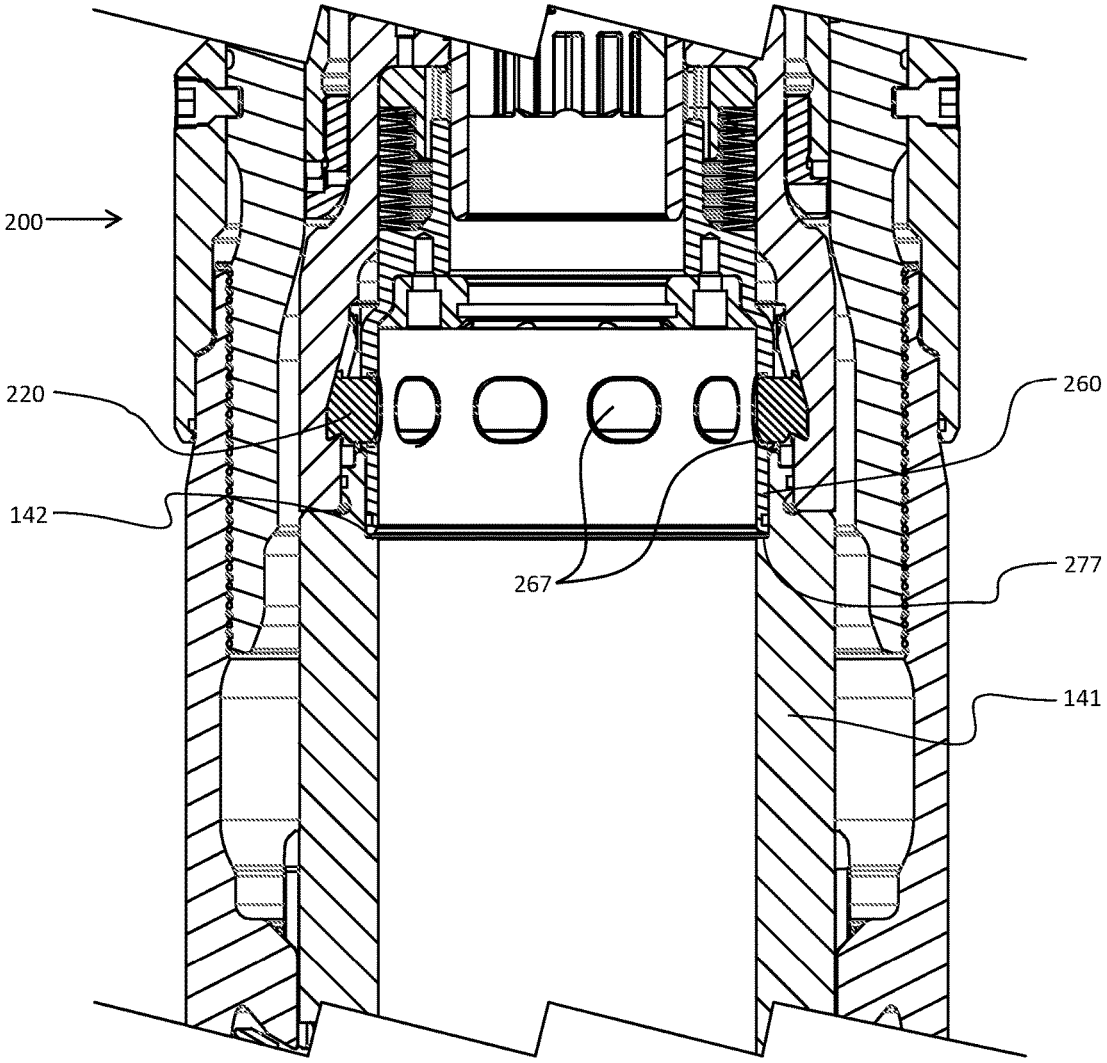
FIG. 4 is an enlarged cross-section similar to FIG. 3, but with the threaded and coupled pipe assembly withdrawn from the gripping tool, and showing grip elements of the gripping tool in their retracted positions.

FIG. 4 is a partial cross-section through an externally-gripping CRT 100 showing in detail the coupling gripper 200 as it would appear in the retracted position, with grip buttons 220 displaced radially outward from grip button carrier 260. For purposes of clarity, seal assembly stinger 161 and casing 85 are not shown in FIG. 4. In the illustrated position, grip buttons 220 are fully retracted, and the Belleville spring stack 270 is fully extended as allowed by the constraints of the assembly maintaining some preload on the carrier 260 such that it is in its downwardmost possible position, with bottom face 277 of carrier 260 engaging upward-facing shoulder 142 of cage 141.

Referring again to FIG. 3, coupling gripper 200 is shown with the upper end face 86 of a threaded and coupled pipe assembly 85 (i.e., the upper end face of coupling 90) in compressive bearing engagement with bearing face 244 of land element 240, such that Belleville spring stack 270 is compressed to allow grip buttons 220 to extend radially inward and to urge internal grip surfaces 221 of grip buttons 220 into gripping engagement with the outer cylindrical surface 92 of coupling 90 of threaded and coupled pipe assembly 85, thus allowing the reaction or transfer of torque through this interface. Torque is reacted simultaneously through two paths starting with the grip button 220 in each case—in the first case reacting through grip button carrier 260 into guide ring 250, to main body 280, and to cam assembly 130, and in the second case through frictional interaction on frustoconical engagement surface 285 of body 280 and into cam assembly 130. Upon release of the axial compressive load applied through drive module 120 of the externally-gripping casing running tool 100, spring stack 270 will cause carrier 260 and grip buttons 220 to extend axially downwards to engage retractor ramps 223 on grip buttons 220 with retractor cone 286 on main body 280, resulting in grip buttons 220 being urged radially outward relative to carrier 260 and out of engagement with coupling 90.

Referring now to FIGS. 3 and 5, coupling gripper 200 is shown disengaged from tubular workpiece 85, with biasing spring 270 urging grip button carrier 260 containing grip buttons 220 to move axially in the downhole direction towards the distal (i.e., lower) end of casing running tool 100. Axial movement of grip buttons 220 relative to main body 280 and retractor ring 290 brings first cam pair 293 into engagement, followed by engagement of second cam pair 294, resulting in radially-outward retractive movement of grip buttons 220 relative to carrier 260.

It is to be understood that the scope of the claims appended hereto should not be limited by the preferred embodiments described and illustrated herein, but should be given the broadest interpretation consistent with the description as a whole. It is also to be understood that the substitution of a variant of a claimed element or feature, without any substantial resultant change in functionality, will not constitute a departure from the scope of the disclosure.

In this patent document, any form of the word "comprise" is to be understood in its non-limiting sense to mean that any element following such word is included, but elements not specifically mentioned are not excluded. A reference to an element by the indefinite article "a" does not exclude the possibility that more than one of the element is present, unless the context clearly requires that there be one and only one such element.

Any use of any form of the terms "connect ", "engage", "couple", "attach", "fix", or any other term describing an interaction between elements is not meant to limit the interaction to direct interaction between the subject elements, and may also include indirect interaction between the elements such as through secondary or intermediary structure.

Wherever used in this document, the terms "typical" and "typically" are to be interpreted in the sense of representative or common usage or practice, and are not to be understood as implying invariability or essentiality.

What is claimed is:

1. A tool for gripping a target surface on a tubular article having an internal cylindrical surface and an external cylindrical surface, where the target surface is a selected one of said internal and external cylindrical surfaces, said tool comprising:

(a) a generally cylindrical main body having an upper end and a lower end, with a lower region of the main body defining a frustoconical surface, arranged to form a downwardly-diverging annular space relative to the target surface when the tubular article is coaxially disposed within the main body;

(b) a plurality of grip elements, with each grip element having a grip surface and a frustoconical surface, said frustoconical surface of each grip element being slidingly engageable with the frustoconical surface of the main body;

(c) a generally cylindrical grip element carrier carrying said plurality of grip elements, said grip element carrier being adapted such that the grip elements are axially movable with the grip element carrier while being radially movable within grip element windows formed in the grip element carrier, said grip element carrier being coaxially disposed within the main body and being axially movable relative thereto;

(d) a generally ring-shaped land element fixed to a downward-facing shoulder formed on the grip element carrier in a region above the grip elements, said land element defining a downward-facing annular bearing face;

(e) a guide ring fixed to a downward-facing shoulder formed on the main body; and (f) preload means, for biasing the grip element carrier downward relative to the main body so as to bias the tool toward a disengaged position, wherein the preload means comprises spring means disposed between a downward-facing shoulder on the guide ring and an upward-facing shoulder on the grip element carrier;

such that application of a sufficient downward axial force to the main body will move the main body axially downward relative to the grip element carrier, thereby bringing the frustoconical surfaces of the grip elements into engagement with the frustoconical surface of the main body and causing radial displacement of the grip surfaces of the grip elements toward the target surface due to axial movement of the grip elements along the frustoconical surface of the main body.

2. A tool as in claim 1 wherein the spring means comprises a Belleville spring stack.

3. A tool as in claim 1, further comprising grip element retraction means.

4. A tool as in claim 3 wherein the grip element retraction means comprises spring means associated with the grip elements.

5. A tool as in claim 1, further comprising, in respect of each grip element, a seal element for sealing between the grip element and the perimeter of its corresponding grip element window in the grip element carrier.

6. A tool as in claim 1 wherein:

(a) the upper end of the main body is fixed to a drive module associated with a tubular running tool, whereby compressive load may be selectively applied by the drive module to the main body; and (b) the lower end of the grip element carrier is fixed in coaxial relationship to the upper end of a cylindrical cage associated with a grip module of the tubular running tool.

7. A tool for gripping a target surface on a tubular article having an internal cylindrical surface and an external cylindrical surface, where the target surface is a selected one of said internal and external cylindrical surfaces, said tool comprising:

(a) a generally cylindrical main body having an upper end and a lower end, with a lower region of the main body defining a frustoconical surface, arranged to form a downwardly-diverging annular space relative to the target surface when the tubular article is coaxially disposed within the main body;

(b) a plurality of grip elements, with each grip element having a grip surface and a frustoconical surface, said frustoconical surface of each grip element being slidingly engageable with the frustoconical surface of the main body;

(c) a generally cylindrical grip element carrier carrying said plurality of grip elements, said grip element carrier being adapted such that the grip elements are axially movable with the grip element carrier while being radially movable within grip element windows formed in the grip element carrier, said grip element carrier being coaxially disposed within the main body and being axially movable relative thereto;

(d) a generally ring-shaped land element fixed to a downward-facing shoulder formed on the grip element carrier in a region above the grip elements, said land element defining a downward-facing annular bearing face;

(e) a retractor cone formed at the base of the frustoconical surface on the main body;

(f) a retractor ramp formed into a lower surface of each grip element, said retractor ramp being configured for retractable engagement with the retractor cone; and (g) preload means, for biasing the grip element carrier downward relative to the main body so as to bias the tool toward a disengaged position;

such that application of a sufficient downward axial force to the main body will move the main body axially downward relative to the grip element carrier, thereby bringing the frustoconical surfaces of the grip elements into engagement with the frustoconical surface of the main body and causing radial displacement of the grip surfaces of the grip elements toward the target surface due to axial movement of the grip elements along the frustoconical surface of the main body.

8. A tool as in claim 7, further comprising a retraction ring axially retained between the main body and a cylindrical cage associated with a grip module of the tubular running tool, said retraction ring having a frustoconical surface slidingly engageable with tapered retraction lips formed on the grip elements.

9. A tool as in claim 7, further comprising grip element retraction means.

10. A tool as in claim 9 wherein the grip element retraction means comprises spring means associated with the grip elements.

11. A tool as in claim 7, further comprising, in respect of each grip element, a seal element for sealing between the grip element and the perimeter of its corresponding grip element window in the grip element carrier.

12. A tool as in claim 7 wherein:

(a) the upper end of the main body is fixed to a drive module associated with a tubular running tool, whereby compressive load may be selectively applied by the drive module to the main body; and (b) the lower end of the grip element carrier is fixed in coaxial relationship to the upper end of a cylindrical cage associated with a grip module of the tubular running tool.

13. A tool for gripping a target surface on a tubular article having an internal cylindrical surface and an external cylindrical surface, where the target surface is a selected one of said internal and external cylindrical surfaces, said tool comprising:

(a) a generally cylindrical main body having an upper end and a lower end, with a lower region of the main body defining a frustoconical surface, arranged to form a downwardly-diverging annular space relative to the target surface when the tubular article is coaxially disposed within the main body;

(b) a plurality of grip elements, with each grip element having a grip surface and a frustoconical surface, said frustoconical surface of each grip element being slidingly engageable with the frustoconical surface of the main body;

(c) a generally cylindrical grip element carrier carrying said plurality of grip elements, said grip element carrier being adapted such that the grip elements are axially movable with the grip element carrier while being radially movable within grip element windows formed in the grip element carrier, said grip element carrier being coaxially disposed within the main body and being axially movable relative thereto;

(d) a generally ring-shaped land element fixed to a downward-facing shoulder formed on the grip element carrier in a region above the grip elements, said land element defining a downward-facing annular bearing face;

(e) grip element retraction means; and (f) preload means, for biasing the grip element carrier downward relative to the main body so as to bias the tool toward a disengaged position;

such that application of a sufficient downward axial force to the main body will move the main body axially downward relative to the grip element carrier, thereby bringing the frustoconical surfaces of the grip elements into engagement with the frustoconical surface of the main body and causing radial displacement of the grip surfaces of the grip elements toward the target surface due to axial movement of the grip elements along the frustoconical surface of the main body.

14. A tool as in claim 13 wherein the grip element retraction means comprises spring means associated with the grip elements.

15. A tool as in claim 13, further comprising, in respect of each grip element, a seal element for sealing between the grip element and the perimeter of its corresponding grip element window in the grip element carrier.

16. A tool as in claim 13 wherein:

(a) the upper end of the main body is fixed to a drive module associated with a tubular running tool, whereby compressive load may be selectively applied by the drive module to the main body; and (b) the lower end of the grip element carrier is fixed in coaxial relationship to the upper end of a cylindrical cage associated with a grip module of the tubular running tool.

* * * * *